US005927539A

United States Patent [19]

Truitt et al.

[11] Patent Number: 5,927,539

[45] Date of Patent: Jul. 27, 1999

[54] MODULAR VENDING MACHINE WITH A DISPENSING DETECTION DEVICE

[75] Inventors: Karl F. Truitt, Williston; Jon L. Swanson, Aiken, both of S.C.

[73] Assignee: Dixie-Narco, Inc., Williston, S.C.

[21] Appl. No.: 08/883,675

[22] Filed: Jun. 27, 1997

[51] Int. Cl.[6] ..... G07F 11/10

[52] U.S. Cl. ..... 221/2; 221/191; 221/194

[58] Field of Search ..... 221/2, 6, 14, 17, 221/194, 195, 191; 340/673

[56] References Cited

U.S. PATENT DOCUMENTS

| | | | |
|---|---|---|---|
| 2,453,280 | 11/1948 | Stewart | 221/14 |
| 2,956,660 | 10/1960 | Norquist | 221/6 |
| 3,254,792 | 6/1966 | Danielson et al. | 221/6 |
| 3,348,733 | 10/1967 | Johnson | 221/6 |
| 3,752,357 | 8/1973 | Harris | 221/17 |
| 4,377,049 | 3/1983 | Simmon et al. | 221/2 |
| 4,757,915 | 7/1988 | Albright et al. | 221/75 |
| 4,860,922 | 8/1989 | Malservisi et al. | 221/6 |

*Primary Examiner*—William E. Terrell
*Assistant Examiner*—Khoi H. Tran
*Attorney, Agent, or Firm*—Renner, Kenner, Greive, Bobak, Taylor & Weber

[57] ABSTRACT

A modular vending machine for dispensing a variety of different sized products with at least one array received within a cabinet, wherein the array is made up of a plurality of storage chambers with a dispensing mechanism disposed at the bottom of each chamber. The cabinet can receive any number of arrays which in turn can receive any number of storage chambers. The modular vending machine further includes a sensing device received within a receiving trough for confirming that a product has actually been dispensed. The dispensing mechanism includes a solenoid actuated plunger wherein the plunger controls the movement of a toggle member which is movable between a blocking position and a dispensing position so that only a single product is dispensed. The vending machine may also provide a two-point locking mechanism for positively securing a door to the cabinet of the vending machine while allowing maximum utilization of the space within the cabinet.

4 Claims, 11 Drawing Sheets

MODULAR VENDING MACHINE WITH A DISPENSING DETECTION DEVICE

TECHNICAL FIELD

The invention herein resides in the art of vending machines and, more particularly, to such machines which are intended for dispensing canned commodities such as soft drinks and the like upon the tendering of cash or its equivalent. Specifically, the invention relates to an easy loading, modularized, positive dispensing vender for such articles. More particularly, the invention relates to a sensing device that determines when a product has been dispensed. Additionally, the present invention relates to a locking mechanism compatible with the modularized, positive dispensing vendor which maximizes storage of the articles.

BACKGROUND ART

The use of vending machines for various consumables is well known. Probably the most common of such venders is the soft drink vending machine in which containers such as cans or bottles of soft drinks are dispensed upon receipt and validation of a tendered value. Vending machines are also known to dispense juice packs, candy bars, and the like. In the past, the containers for such soft drinks have typically been of a uniform size. However, such beverages presently are found in various sizes of containers and vending machines must necessarily be tailored to accommodate a wide range of container sizes and shapes. Previously, vending machines were quite inflexible to receiving, maintaining, and dispensing containers of various sizes. Often, shims or the like were required to modify the storage column and dispensing mechanism for that purpose. Additionally, wasted space often resulted from such modifications, since the storage columns would necessarily be designed to accept the largest container and then be reconfigured downwardly to accept smaller containers—the difference in size between the containers constituting wasted space. Additionally, in the prior art, modifications to vending machines to customize them for particular containers was a laborious and time consuming proposition.

In previously known dispensers, the actual dispensing mechanism has also been particularly troublesome. In the past, rotating motors positioned at the bottom of the storage columns has provided for the ultimate dispensing of a container of the selected beverage. Oftentimes, cam actuation has been involved and timing problems associated with the dispensing have been encountered. Additionally, rotary motors are expensive and given to maintenance and/or reliability problems.

In the past, it has also been generally assumed that when a dispense cycle is actuated for the vending machine, the selected product is actually dispensed—without any confirmation of that activity at all. Based upon that assumption, if a selected container does not actually reach the consumer, the consumer is dissatisfied and the owner of the vending machine is often troubled by a complaint.

There is a need in the art for a modularized vending machine, given to ease of customization for acceptance of soft drinks in various sizes of containers and having a reliable and inexpensive dispensing mechanism. Moreover, there is a need in the art for a modularized vending machine which precludes customer dissatisfaction by employing a sensing device to confirm that a dispensing event has taken place. In light of the aforementioned need to provide a modularized vending machine, it will be appreciated there is a need to maximize the amount of storage space within the cabinet of the vending machine. Accordingly, there is little room for a locking mechanism to be provided within the cabinet for securing a door that encloses the cabinet. As such, there is a need in the art for a locking system which does not impede upon the modular concept of the vending machine, but yet still provides an adequate level of security.

DISCLOSURE OF INVENTION

In light of the foregoing, it is an aspect for the invention to provide a vending machine having modular storage columns.

Another aspect of the invention is to provide a vending machine having modular storage columns which may be easily loaded from the top of the columns.

Yet a further aspect of the invention is the provision of a vending machine having modular storage columns which allow for staggered vertical stacking of the containers to maximize the number of containers to be received in a particular space.

Yet an additional aspect of the invention is the provision of a vending machine having modular storage columns which have means for retarding the drop rate of cans and containers thereinto.

Still a further aspect of the invention is the provision of a vending machine having modular storage columns which are received on tracks for easy access, and which may be easily removed, replaced, and interchanged.

Yet an additional aspect of the invention is the provision of a vending machine having modular storage columns which incorporates a solenoid actuated toggling dispenser at the bottom of each such column.

Yet an additional aspect of the invention is the provision of a vending machine wherein a sensor is provided in association with the dispensing mechanism to sense the actual dispensing of a product and the passing thereof to a point of accessibility by a customer.

Still another aspect of the invention is the provision of a vending machine which provides a shortened vend cycle following the depression of a product button.

Still a further aspect of the invention is the provision of a vending machine capable of dispensing a diversity of package shapes and sizes from the same machine.

Another aspect of the present invention is to provide a vending machine with a locking system that allows for maximum utilization of cabinet space to hold product therein.

Still another aspect of the present invention, as set forth above, is to provide cabinet latches, extending from an inside panel of the cabinet, that mate with a latching mechanism.

Yet a further aspect of the present invention is to provide a latching mechanism, which includes door latches, that engages the cabinet latches by movement of a slide bar carried by the door of the vending machine.

Still yet another aspect of the present invention, as set forth above, is to provide door latches which integrally extend from the slide bar or which are connected to the slide bar by gear linkage.

A further aspect of the present invention is to control the linear movement of the slide bar by rotational movement of a T-bar handle.

The foregoing and other aspects of the invention which will become apparent as the detailed description proceeds are achieved by a dispensing detection device adapted for use in a vending machine, comprising: a plurality of detector plates for directing a dispensed product to a receiving trough; and means for sensing whether a dispensed product has passed over one of the plurality of detector plates onto the receiving plate.

Additional aspects of the invention which shall become apparent herein are attained by a dispensing detection device for determining when a product is dispensed from a vending machine, comprising: a plurality of downwardly directed chute plates disposed under a like plurality of cover plates to direct a dispensed product into a receiving trough; and means for sensing when a dispensed product has passed into the receiving through, wherein the sensing means is disposed between each corresponding chute plate and the cover plate.

Yet another aspect of the invention which will become apparent herein is attained by a locking system used in securing a hinged door to a cabinet of a vending machine, comprising at least two cabinet latches extending from an interior side panel of the cabinet and a latching mechanism coupled to an interior edge of the door, wherein the latching mechanism slidably engages at least two cabinet latches to secure the door to the cabinet.

Still another aspect of the present invention which will become apparent as the detailed description proceeds are achieved by a vending machine with a locking system, comprising a cabinet for receiving arrays that hold dispensable goods, the cabinet having an interior side panel from which outwardly extends at least two cabinet latches; and a door for enclosing the cabinet, the door providing an interior edge from which extends a latching mechanism that slidably engages at least two cabinet latches to lock the door to the cabinet.

DESCRIPTION OF DRAWINGS

For a complete understanding of the objects, techniques, and structure of the invention reference should be made to the following detailed description and accompanying drawings wherein.

BEST MODE FOR CARRYING OUT THE INVENTION

Figure 1:
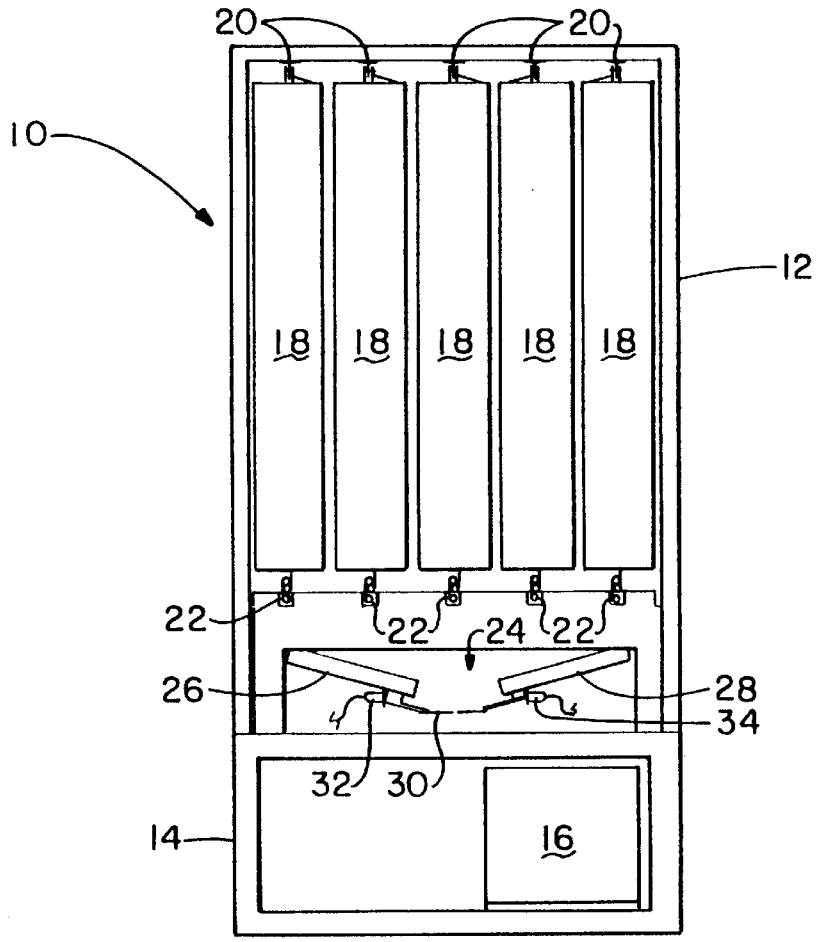
FIG. 1 is an illustrative front elevational view of a vending machine cabinet according to the invention, with the door removed.

Referring now to the drawings and more particularly FIG. 1, it can be seen that a vending machine made in accordance with the invention is designated generally by the numeral 10. The vender 10 is defined by a housing or cabinet 12, typically of metal construction. A base compartment 14 of the cabinet 12 is adapted for receiving an appropriate refrigeration system 16.

In an upper portion of the cabinet 12 there is provided a plurality of arrays of modular container stacking columns 18, there being five shown in the drawing. The arrays 18 are maintained and received between tracks 20, 22 respectively at the top and bottom of each such array. In implementation, the sliding tracks 20, 22 are of a somewhat standard nature such as typically known drawer guides, comprising a pair of slidingly engaged track members which may have bearings or the like interposed therebetween. As will be discussed in further detail below, one of the members of each of the tracks 20, 22 is connected to the associated array 18, while the other member is connected to a fixed portion of the cabinet 12. As further shown in FIG. 1, the upper tracks 20 and lower tracks 22 are typically positioned with respect to each other such as to provide for secure and balanced maintenance of the arrays 18.

A receiving trough 24 is maintained within the cabinet 12 beneath the assembly of arrays 18, as shown. The receiving trough 24 is defined by a pair of downwardly angled converging plates 26, 28 which are intended to direct cans or other products released from any of the stacking columns of the arrays 18 to a receiving plate 30 where the container can be retrieved by a customer.

Also included as a portion of the instant invention is a means for sensing the actual dispensing of a container of beverage. For this purpose, an optical transmitter 32 and receiver 34 are positioned on opposite sides of the trough 24 at the receiving plate 30. When the light beam extending between the two is interrupted by a passing container, the resultant signal is taken as an indication that a container has actually been dispensed. It will, of course, be appreciated that the element 34 might comprise an optical transducer consisting of both a transmitter and receiver, with the element 32 simply being a reflective surface for that purpose. In any event, the concept of the invention provides a means at the dispensing trough for actually monitoring the dispensing of a container. In the event that the dispensing mechanism is actuated, but no container is sensed, the vending machine 10 can determine that there are no more containers of the requested beverage available for dispensing, or that the associated storage column is jammed, or that some other condition exists preventing dispensing of the associated beverage. Appropriate remedial action can then be taken. While an optical sensor has been described, it will be appreciated that a variety of other sensors may be employed.

Figure 2:
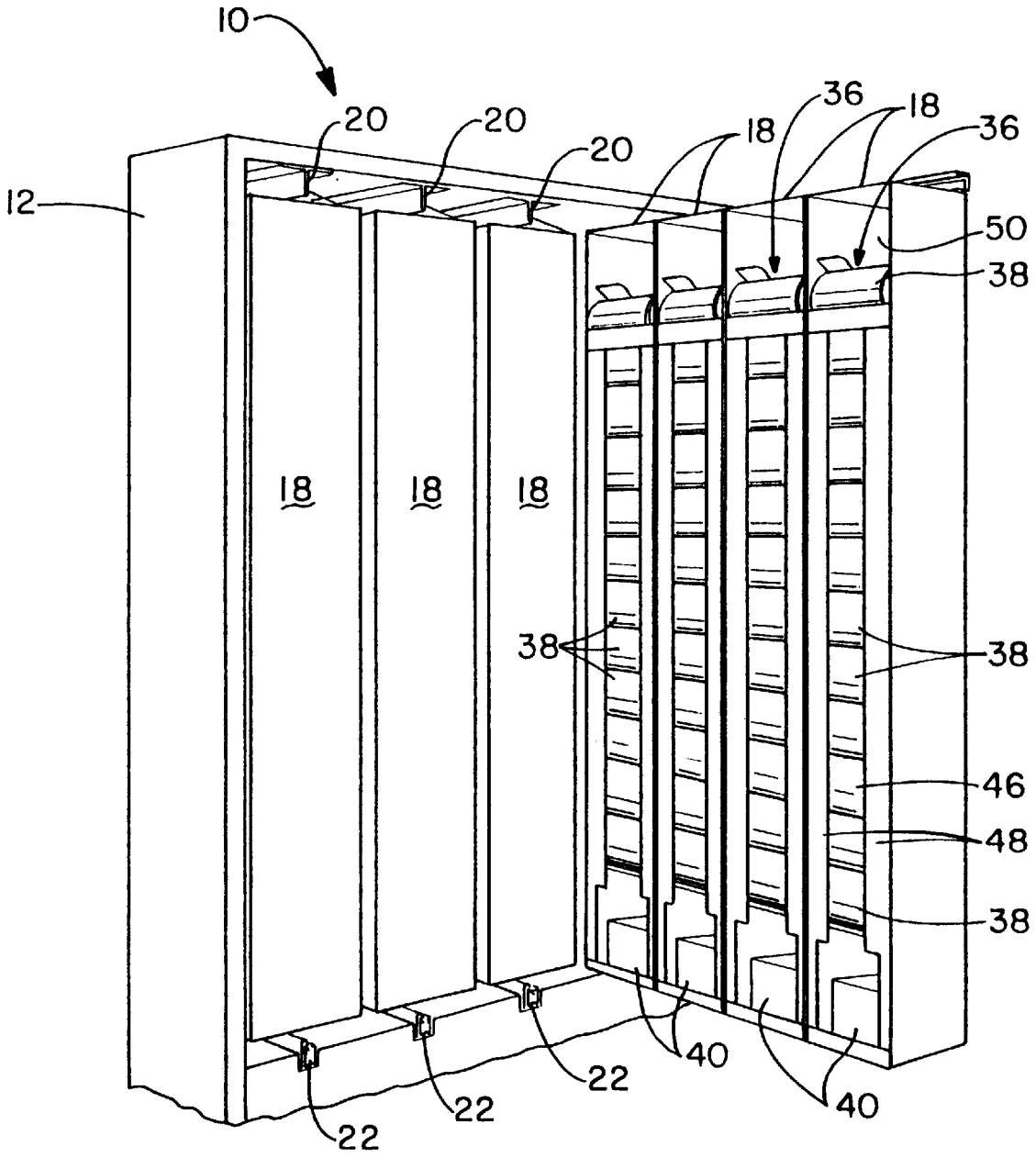
FIG. 2 is an isometric view of a vending machine according to the invention, showing an array of storage columns being retracted from the cabinet thereof.

With reference now to FIG. 2, it can be appreciated that the arrays 18 of modular container stacking columns can be readily withdrawn from the cabinet 12 upon the tracks 20, 22. Such withdrawal allows for the servicing of the vending machine 10 by the replenishment of containers in the various modular stacking columns 36. Additionally, it also allows for the modification of the stacking column as desired. In other words, while four modular container stacking columns 36 are shown in the array 18 withdrawn from the cabinet 12 in FIG. 2, the array 18 might only include three or two modular storage columns 36, each receiving much larger containers than those presently shown. It will also be appreciated that various shaped containers could be stored in the columns 36.

As further shown in FIG. 2, each of the storage columns 36 maintains a plurality of containers 38 which could be cans, bottles or other products. As will become apparent later herein, conservation of space is attained by vertically stacking the containers 38 in a staggered arrangement, with the central axis of the containers 38 being horizontally maintained.

At the bottom of each of the storage columns 36 is a dispensing mechanism 40 which will be discussed later herein. Suffice it to say at this time, that each of the dispensing mechanisms 40 is a solenoid actuated, positive acting, toggling device which assures the positive dispensing of a single container 38 upon each actuation.

Figure 5:
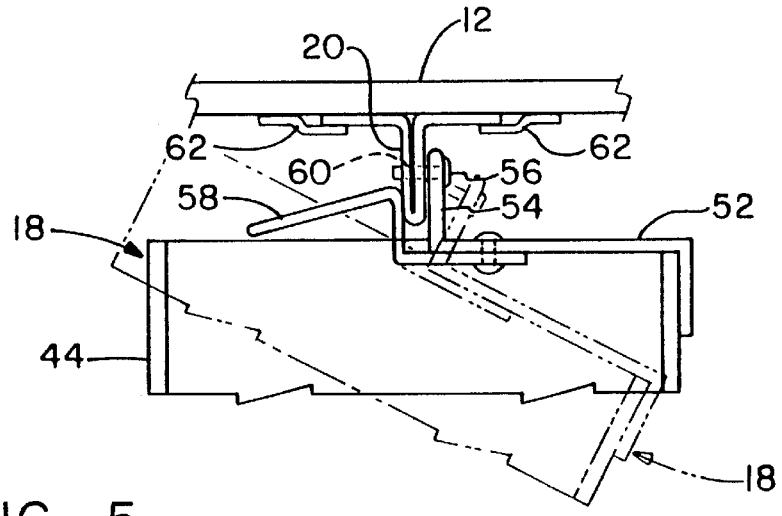
FIG. 5 is a partial cross-sectional view of the storage column carried by the cabinet.
Figure 3:
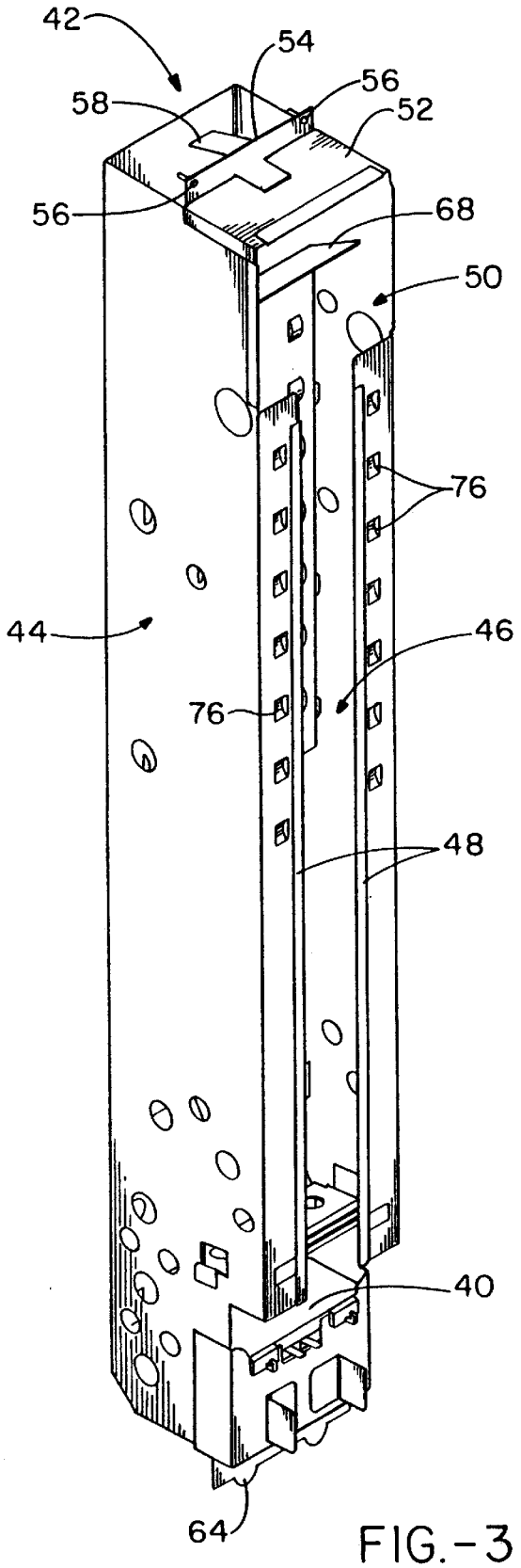
FIG. 3 is an isometric view of a storage column according to one embodiment of the invention.
Figure 4:
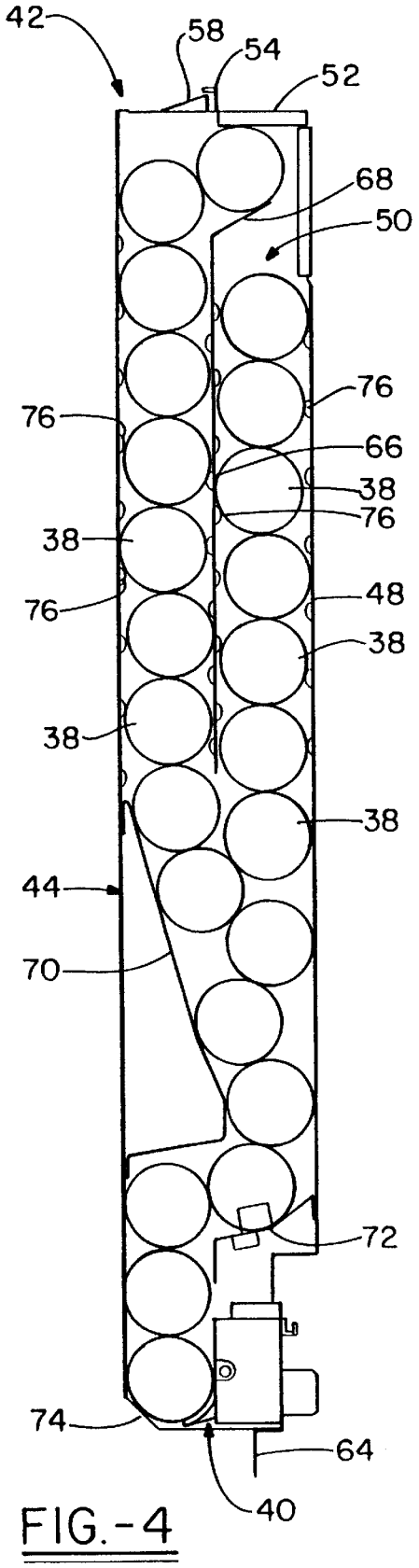
FIG. 4 is a side elevational view of the storage column of FIG. 3.

Referring now to FIGS. 3, 4 and 5, an appreciation of one storage column 42 made in accordance with the invention can be seen. Here, the storage column 42 comprises a vertically elongated rectangular housing 44 which is closed on three sides thereof and provided with a center opening 46 down the front thereof as defined by a pair of opposed side flanges 48. An opening 50 at the top of the front of the housing 44 is provided for placement of containers 38 therein. A top plate or cap 52 is provided at the top of the housing 44 to close the same. A flange 54 extends upwardly from a central portion of the cap 52 with a pair of locator pins 56 carried by the flange 54 at each end thereof. Centrally disposed along and spaced from the flange 54 is a latch spring 58 which is connected to the cap 52. An upper track 20, secured to the cabinet 18 by brackets 62 and slidable therein, is adapted to engage the storage column 42 by receipt between the flange 54 and latch spring 58, is presented below.

The storage column 42 may be placed into an array 18 by placing the flange 64, extending downwardly from the bottom of the housing 44, into a receiving slot in a lower sliding track 22. With the upper track 20 having a plurality of apertures 60 extending there along, the lateral position of the storage column 42 may be established by selected engagement of the locator pins 56 with specific apertures 60, with the track 20 being secured between the latch spring 58 and the flange 54. With the storage column 42 slightly tilted away from the vertical as shown in FIG. 5, it may be positioned along the lower track 22 at a desired position, at which time the storage column 42 is pivoted to vertical position as shown in FIG. 5, with the latch spring 58 being deflected by the track 20 until the track 20 engages the flange 54 and the pins 56 are appropriately received in the apertures 60. The storage column 42 is thus fixedly secured between the upper and lower tracks 20, 22. Although FIG. 5 shows the latch spring 58 as a separate element, it will be appreciated that the cap 52 could be formed with the latch spring 58 as an integral element thereof.

As best shown in FIG. 4, a center partition 66 is maintained within the housing 44 and serves to divide the chamber of the storage column 42 into two distinct halves at the upper portion thereof. An in-feed ramp 68 extends from the centered partition in an upward angular posture toward the opening 50. Accordingly, containers inserted through the opening 50 upon the ramp 68 roll down one side of the cavity, while cans inserted through the opening 50 beneath the ramp 68 roll down the other. A deflecting plate 70 extends from an inner surface of the rear wall of the housing 44 inwardly toward the front wall thereof, to neck down the cavity from one accommodating two stacks of containers 38, to one containing a single stack. It will be appreciated that the deflecting plate 70 begins at an area near the bottom of the center partition 66 and ramps inwardly toward the front flanges 48 to converge the two channels defined by the center partition 66 into one.

A return plate 72 extends inwardly from the rear flanges 48 and directs the ingle column of containers toward the front of the chamber defined by the housing 44 and then downwardly to the dispensing mechanism 40. An opening 74 is provided at the lower rear corner of the housing 44 rearwardly of the dispensing mechanism 40 which has a member partially blocking the opening 74 until actuated to allow the dispensing of a single container 38. The operation of the mechanism 40 in that regard can be discussed later herein.

Also provided as a portion of the instant invention are dimples or staked protrusions 76 which extend inwardly into the cavity of the housing 44 from the rear plate and front flanges thereof. Additionally, dimples or protrusions 76 also extend from opposite sides of the center partition 66, as shown. It will also be noted that the dimples or protrusions 76 formed as a portion of the housing 44 and those formed as a portion of the partition 66 are off set with respect to each other. These dimples or protrusions 76 are of sufficient amplitude and frequency to retard the movement of a container downwardly along the associated channel. In other words, the container will effectively "walk" back and forth within the channel between the dimples as it progresses downwardly in the cavity of the housing 44. Accordingly, the dimples or protrusions 76 retard or slow the downward movement of the containers 38 to prevent denting, rupturing, or damage thereto. Additionally, the dimples or protrusions 76 are so spaced as to prevent the insertion of containers 38 into the stack in other than a horizontally aligned posture. In other words, the containers can not be inserted with their major axis in other than a horizontal position.

Figure 6:
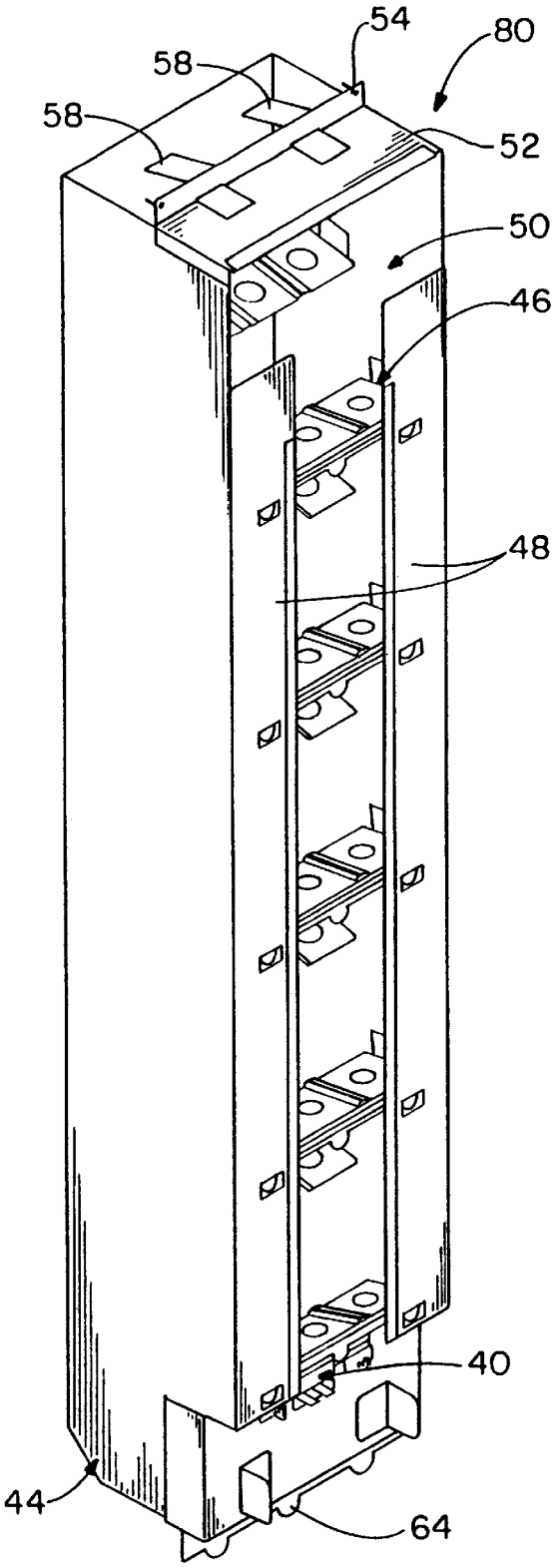
FIG. 6 is an isometric view of a storage column according to a second embodiment of the invention.
Figure 7:
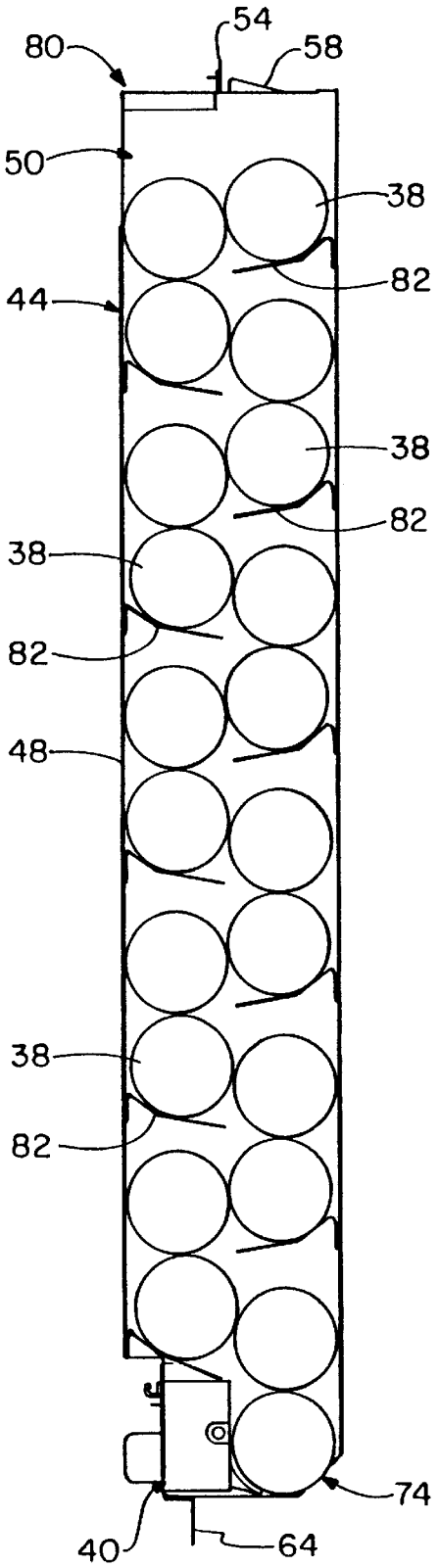
FIG. 7 is a side elevational view of the storage column of FIG. 6.

Referring now to FIGS. 6 and 7, an alternative storage column 80 made in accordance with a second embodiment of the invention can be seen as generally designated by the numeral 80. It will be appreciated that much of the structure of the assembly 80 corresponds to that of the storage column 42 and, in that regard, similar reference numerals have been employed. Of particular interest, however, is the provision of downwardly angled guide plates 82 extending between the side walls of the housing 44 in the embodiment 80. The guide plates 82 alternate between the rear wall and the front flanges of the storage column 80 in downward step-wise fashion from the access opening 50. Accordingly, as containers are placed into the storage column 80, they roll downwardly reciprocating from front to rear in the cavity defined by the housing 44 to establish a staggered vertical column of containers 38. Again, the dispensing mechanism 40 blocks the outlet opening 74 to allow for selected single dispensing of containers in a manner which will become apparent directly below.

Figure 8:
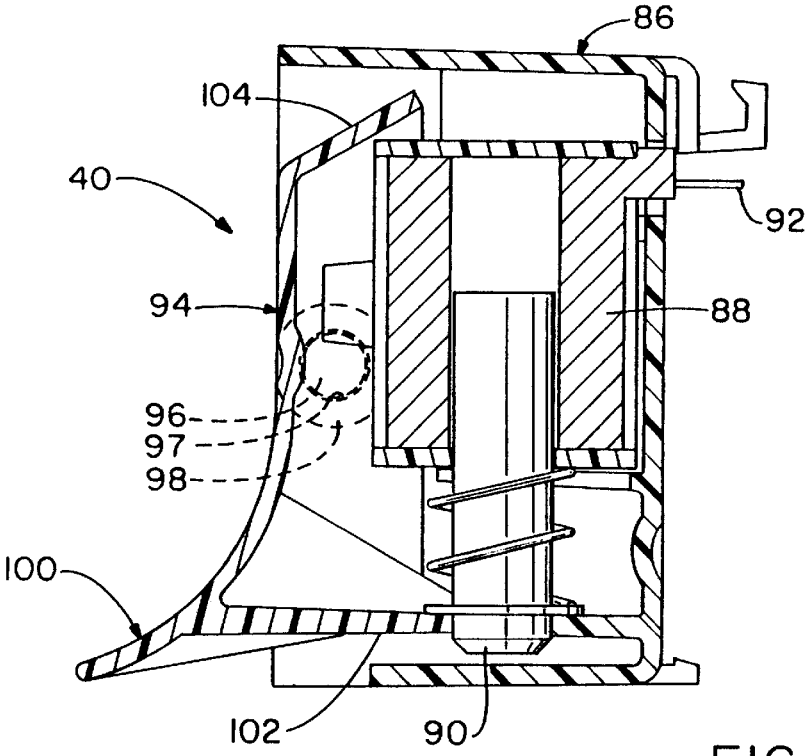
FIG. 8 is a side elevational view in partial cross-section of the solenoid-actuated toggling dispensing mechanism of the invention in a support mode.
Figure 9:
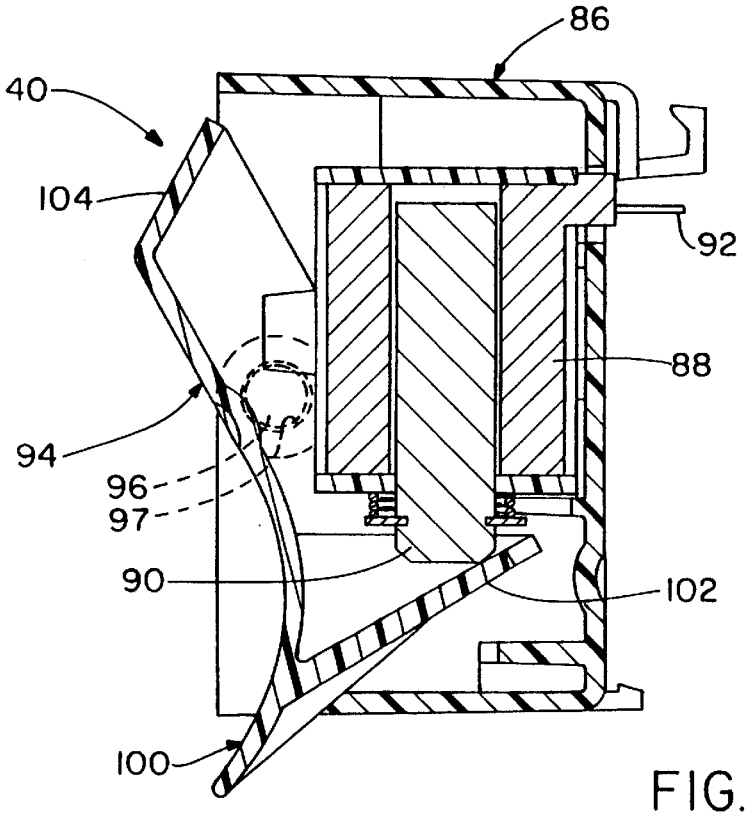
FIG. 9 is a side elevational view in partial cross-section of the mechanism of FIG. 8 in a dispense mode.

Referring now to FIGS. 8 and 9 an understanding of the structure and operational technique of the dispensing mechanism 40 can be attained. As illustrated, the dispensing mechanism 40 includes a housing 86 receiving a solenoid 88 having an associated spring biased solenoid plunger 90 reciprocatingly received thereby. A pair of electrical contacts 92 extend from the solenoid 88 in standard fashion. A toggle member 94 has outwardly extending pins 96 pivotally received within the housing 86 through apertures 97 in parallel side flanges 98. A bottom support surface 100 extends outwardly at a bottom end of the toggle member 94 and is in a generally curved posture at the opening 74 at the bottom corner of a storage column 42, 80 of FIGS. 3–7. The bottom support surface 100 is adapted to receive the lowermost container in the column of containers received by the associated storage column and to support such stack of containers thereby.

Extending in a direction opposite that of the bottom surface plate 100 is an actuation tab 102. It will be appreciated that, with the containers engaging the bottom support surface 100, the toggle member 94 will be urged about the pivot axis pin 96 such that the actuation tab 102 is in engagement with the solenoid plunger 90. In this position, the column of containers 38 is in a quiescent state. When it is desired to dispense a container 38, the solenoid 88 is actuated and the plunger 90 withdrawn. Accordingly, engagement between the actuation tab 102 and plunger 90 is lost such that the toggle member 94 pivots about the axis pin 96 in such a manner as to remove the bottom support surface 100 from its blocking position in the opening 74, thus allowing the lowermost container 38 to pass through the opening 74 and be dispensed. The rotational movement of the toggle member 94, as best shown in FIG. 9, causes a blocking lip 104 at an end of the toggle member 94 opposite that of the bottom support surface 100, to enter into the column of containers 38 and to receivingly engage that container 38 next to the lowermost container. Accordingly, while the lowermost container 38 is allowed to be dispensed through the opening 74 by the rocking action of the toggle member 94, that same rocking action secures and retains the remainder of the column of containers 38 substantially in their original position. Following the dispensing, the solenoid 92 is deactivated such that the spring biased plunger 90 is urged downwardly against the actuation tab 102 to prevent subsequent vend cycles while allowing the weight of the remaining containers to rock the toggle member 94 to its normal position as shown in FIG. 8. As a consequence, all of the containers 38 index downwardly the distance of one container, such that the container previously retained by the blocking lip 104 is now received and supported by the bottom support surface 100, becoming the lowermost container ready for dispensing.

It should be readily appreciated that the height of the toggle member 94 is substantially equivalent to the diameter of a container 38 to be dispensed, such that the toggling action of the member 94 allows the lowermost container to be dispensed and the next container to be engaged by the blocking lip 104.

It will be readily appreciated by those skilled in the art that the storage columns 42, 80 according to the invention may be of various dimensions, adapted for receiving various different sizes of containers. Accordingly, the arrays 18 of the modular container storage columns 36 may be comprised of various interchangeable sizes of columns 42, 80 such that products in various sizes of containers can be accommodated, space utilization optimized, and dispensing effectiveness maximized. Some arrays 18 may have four storage columns, while others may have only two or three, depending upon the configuration of the container being accommodated. In any event, the interchangeability of the storage columns 42, 80 allows for the achievement of a modularized vending machine which can be tailored in the factory or field to accommodate different containers, while achieving optimum dispensing effectiveness.

Figure 10:
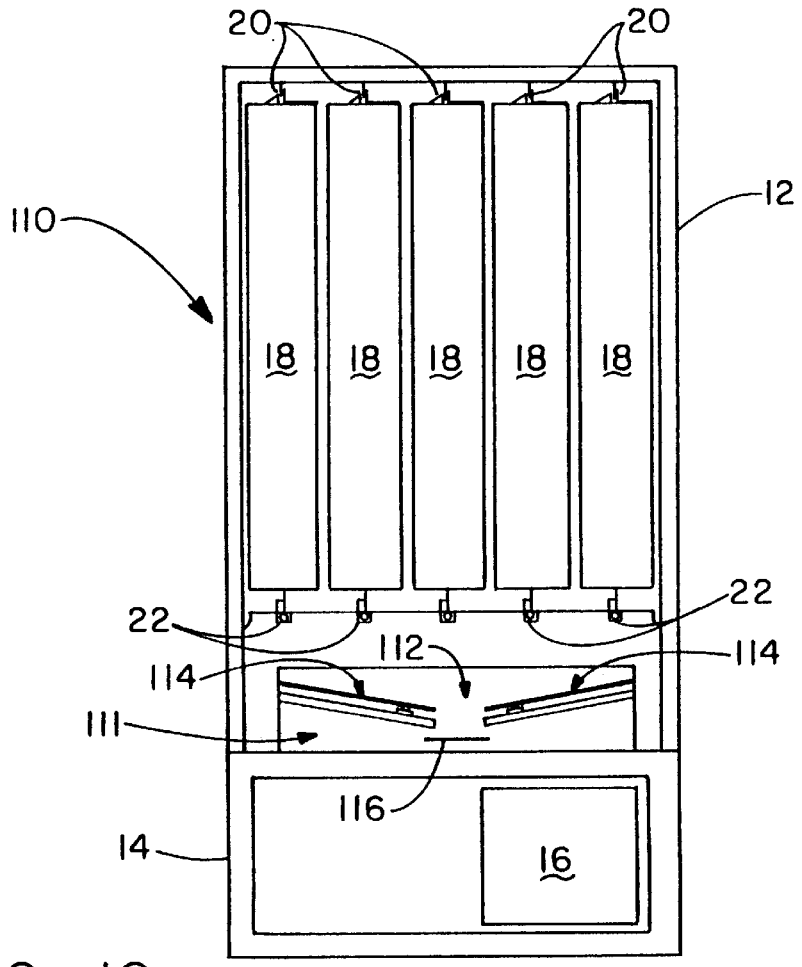
FIG. 10 is an illustrative front elevational view of a vending machine cabinet according to the invention, with the door removed and specifically illustrating the dispensing detection system.
Figure 11:
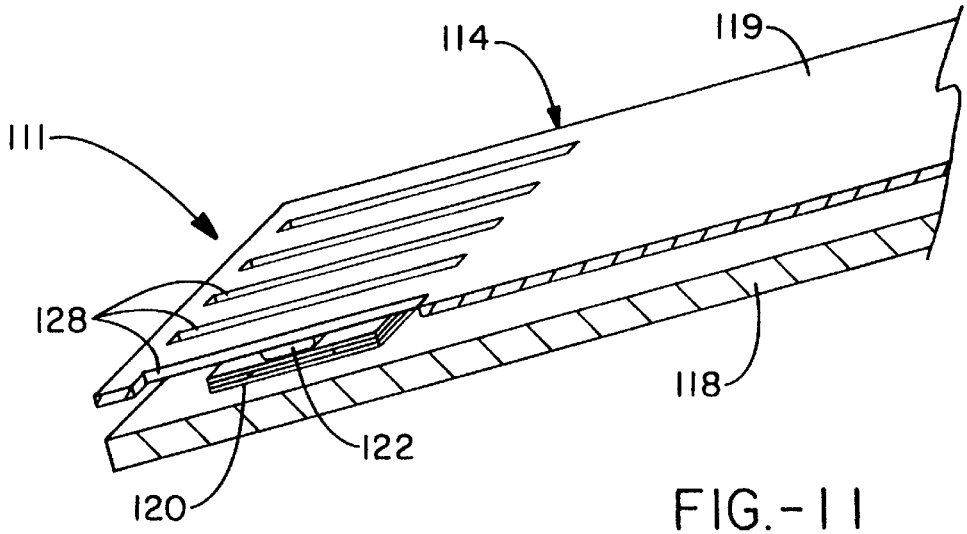
FIG. 11 is a perspective view in partial cross-section of one embodiment of the dispensing detection system.
Figure 12:
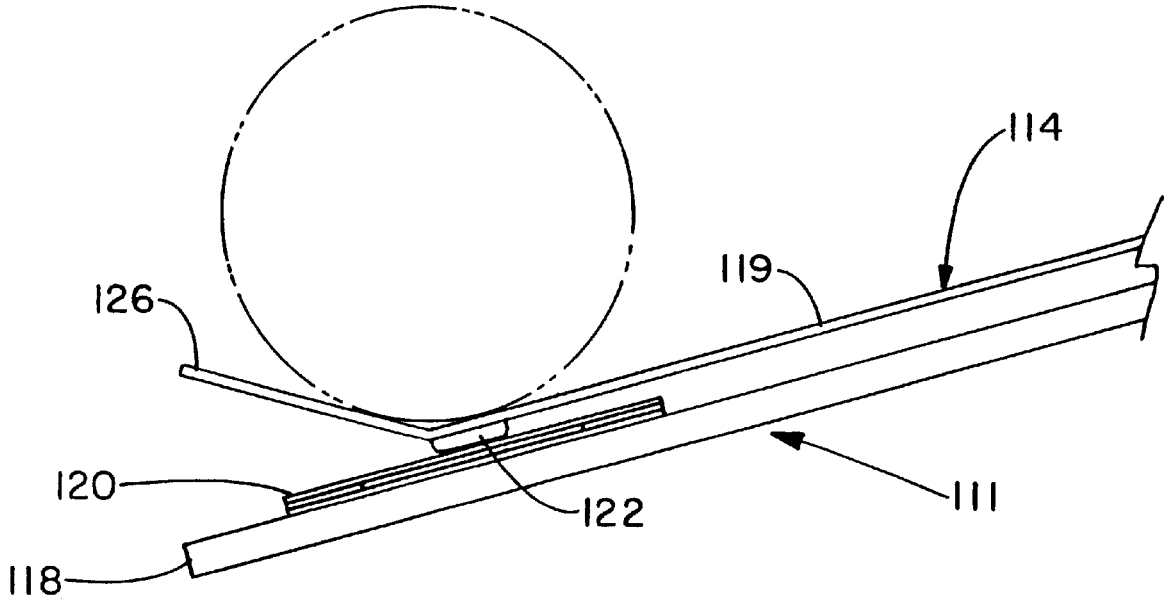
FIG. 12 is a side elevational view in partial cross-section of an alternative dispensing detection system.

Referring now to FIGS. 10, 11 and 12, it can be seen that a vending machine 110 employs a dispensing detection device designated generally by the numeral 111. The device 111 provides a receiving trough 112 that is defined by a plurality of detector plates 114 for downwardly directing a dispensed product to a receiving plate 116. As discussed previously, a means for sensing is provided to monitor the actual dispensing of a container of beverage or product. Generally, if a dispensing mechanism is actuated, but no container is sensed entering the receiving trough 112, the vending machine 110 can undertake appropriate remedial action to minimize customer dissatisfaction.

As best seen in FIGS. 11 and 12, the dispensing detection device 111 provides downwardly angled detector plates 114. In particular, each detector plate 114 includes a chute plate 118 that is opposed by a corresponding substantially parallel cover plate 119. It will be appreciated that the cover plate 119 provides the support surface for a dispensed product as it is transferred from the storage columns onto the receiving plate 116. The cover plate 119 also protects the means for sensing from wear caused by products passing over.

In order to sense whether a dispensed product has passed over at least one of the detector plates 114, a membrane switch 120 and a force director 122 are disposed between the chute plate 118 and the cover plate 119. In particular, the membrane switch 120, which is configured in a normally open position, is placed proximate the force director 122 such that when the dispensed product passes over the force director 122, the membrane switch 120 is closed, completing a circuit that registers that a product has in fact been dispensed. The force director 122 is of sufficient size and rigidity to concentrate and transfer any downward force generated by a dispensed product moving over the detector plate 114 to actuate the membrane switch 120. Although the sensing mechanism is shown with the membrane switch 120 adjacent the chute plate 118 and the force director 122 adjacent the cover plate 119, it will be appreciated that the membrane switch 120 could be disposed adjacent the cover plate 119 and the force director 122 be disposed adjacent the chute plate 118. Those skilled in the art will appreciate that the membrane switch 120 has a first and second contact wherein a 50K ohm resistor is connected therebetween to monitor sensor present condition. When a dispensed product closes the membrane switch 120 the resistance between the two contacts changes to less than 100 ohms so as to effectively form a short circuit. This short circuit is detected by a control circuit in the vendor 110 and the appropriate remedial action is taken. If desired, the resistance values designating an open circuit and a short circuit can be adjusted to increase or decrease the sensitivity of membrane switch 120.

To further assist the operation of the dispensing detection device 111, the cover plate 119 may have slots 128 in the area around and above the force director 122 for the purpose of reducing pre-load stresses upon the membrane switch 120. The slots 128 reduce the possibility of a detection event occurring when in fact one has not. Pre-load stresses can also be reduced by reducing the thickness or weight of the chute plate 119 around the area of the membrane switch 120.

FIG. 12 shows an alternative dispensing detection device wherein the cover plate 119 has an extending member 126 to further enhance the operation thereof. In particular, the extending member 126 forms an obtuse angle with respect to the cover plate 119 in such a manner that the weight of the dispensed product is positioned directly above the force director 122. Therefore, in operation, as a dispensed product proceeds downwardly along the cover plate 119, the product momentarily strikes the extending member 126 to further concentrate the force thereof into the force director 122. Thus it will be appreciated that detection events are more likely to be registered when a product is dispensed. It will also be appreciated that the obtuse angle formed between the extending member 126 and cover plate 119 is selected so as not to interfere or interrupt the dispensing process. In this embodiment, the obtuse angle ranges from about 120° to about 150°.

It should be apparent from the structure and operation of the dispensing detection device 111 shown in FIGS. 11 and 12 that several advantages are realized over vending machines without detection devices. First, a repeatable mechanism is provided that confirms whether a dispensing event has taken place and as such allows for remedial action to be taken when needed. Moreover, these embodiments preclude alignment problems that sometimes occur with optical based detection systems. Finally, the embodiments shown in FIGS. 11 and 12 provide a detection system that can be easily replaced and that requires little maintenance.

Figure 13:
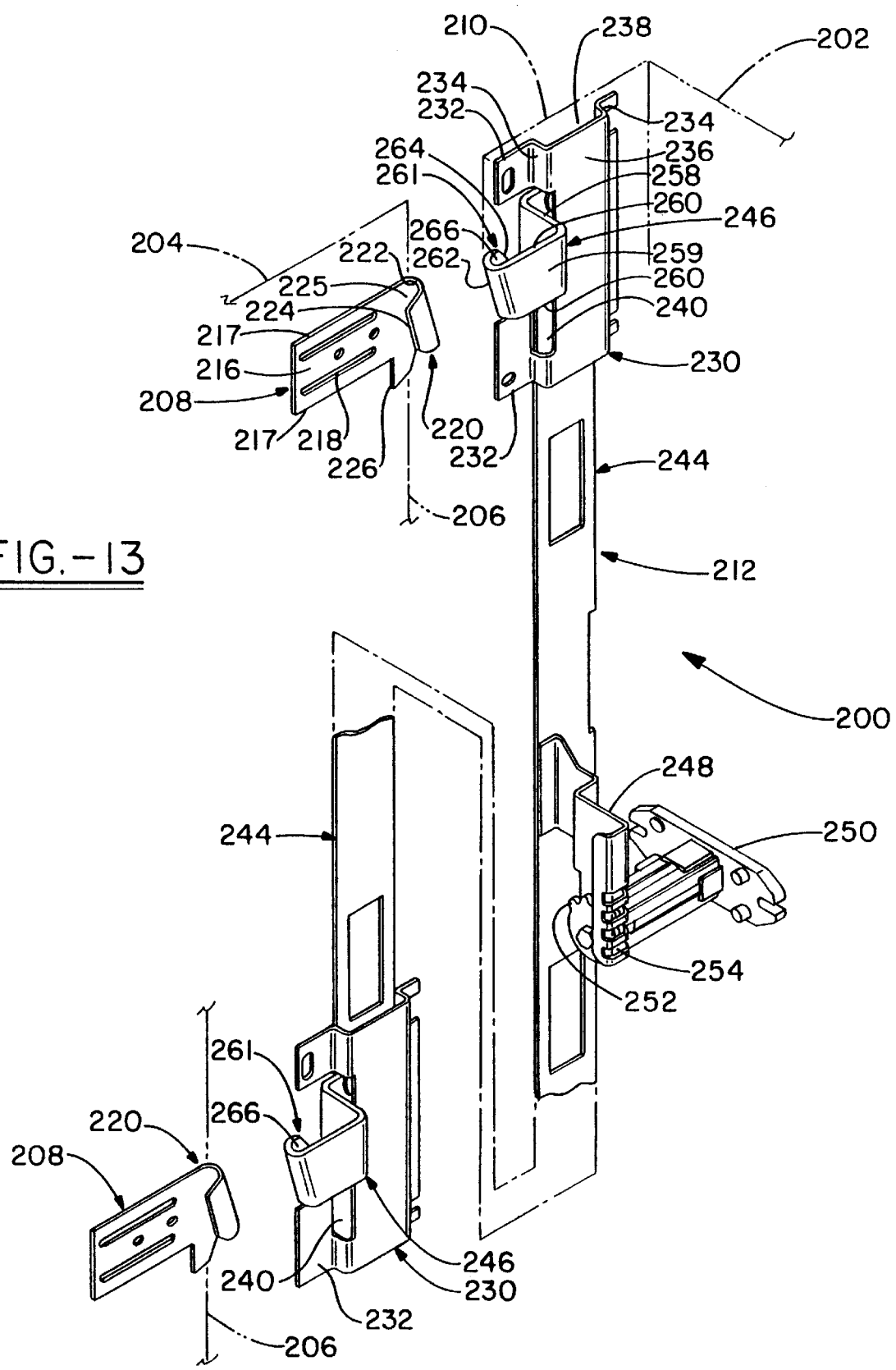
FIG. 13 is an isometric view of a locking system according to the present invention.

Referring now to the FIGS. 13–15, it can be seen that a locking system, designated generally by the numeral 200, may be employed with the vending machine 10 as presented hereinabove. The locking system 200 is employed to provide positive engagement between a door 202 and a cabinet 204 of the vending machine. The door 202 is typically connected to the cabinet 204 by a hinge (not shown) disposed along one lengthwise edge of the door and cabinet. At the opposite lengthwise edge of the door 202, the cabinet 204 provides an interior side panel 206 which has affixed thereto and extending outwardly therefrom at least two or more cabinet latches 208. The cabinet latches 208 are typically disposed at a top and bottom of the interior side panel 206. Along a facing edge of the door 202 is an interior edge 210 which carries a latching mechanism 212. It will be appreciated that the door 202 is constructed like a box top or cap to allow for inclusion of lighting fixtures, advertisement panels and the like within the door and separate from the cabinet 204. As such, the door 202 provides ample room for carrying the latching mechanism 212. As will be discussed in further detail hereinbelow, the latching mechanism 212 is movable between an engaged and unengaged position with respect to the cabinet latches 208 to provide secure attachment therebetween.

The cabinet latches 208 extend outwardly from the interior side panel 206 to minimize the amount of space required to utilize the locking system 200 and to maximize the amount of storage space within the cabinet 204. Each cabinet It should be apparent from the structure and operation of the dispensing detection device 111 shown in FIGS. 11 and 12 that several advantages are realized over vending machines without detection devices. First, a repeatable mechanism is provided that confirms whether a dispensing event has taken place and as such latch 208 includes a flat plate 216 having opposed sides 217. The flat plate 216 provides a pair of slots 218 to accept fasteners for securing each cabinet latch 208 to the interior side panel 206. Disposed at one end of the flat plate 216 is a C-channel 220 which provides a substantially perpendicular extending edge 222 from which extends a substantially perpendicular lip 224. The C-channel 220 provides a grove 225 between the flat plate 216, the edge 222 and lip 224. A guide tab 226 may extend downwardly from one of the opposed sides 217 to facilitate engagement between the cabinet latches 208 and the latching mechanism 212.

The latching mechanism 212 includes at least two brackets 230 mountable to the interior edge 210 and disposed at the top and bottom thereof. It will be appreciated that the number of brackets 230 corresponds to the number of cabinet latches provided. Each bracket 230 includes tabs 232 which receive fasteners for mounting the bracket 230 to the interior edge 210. Extending from the tabs 232 are sidewalls 234 which are interconnected by a base 236 which is substantially parallel to the interior edge 210. It will be appreciated that when the bracket 230 is mounted upon the interior edge 210, the base 236 and the interior edge 210 form a bar opening 238 therebetween. Additionally, the sidewall 234 facing the cabinet 204 provides a latch opening 240 along the length thereof.

A slide bar 244 is received within each of the bar openings 238 of the brackets 230 and extends the entire length of the door or at least between the mounting brackets 230 provided.

A door latch 246 is coupled to each end of the slide bar 244 and mates with the facing cabinet latch 208. Therefore, it will be appreciated as the slide bar 244 is moved up and down, the door latches 246 move in a like manner and are engageable with the facing cabinet latches 208.

A rack 248 extends transversely from about a midpoint of the slide bar 244 and is coupled to a T-bar 250 which provides gear teeth 252 at one end thereof. It will be appreciated that the T-bar 250 is rotatably mounted to the rack 248 wherein the gear teeth 252 are received within openings 254 provided by the rack 248. As the T-bar 250 is rotated, the gear teeth 252 mesh with the openings 254 and cause linear motion of the slide bar 244, which in turn moves the door latches 246 in the desired direction.

Each door latch 246 includes a clearance plate 258 which extends substantially perpendicularly from the slide bar 244. As seen in FIG. 13, a portion of the slide bar 244 extends through the latch opening 240 and from that portion extends a clearance plate 258. Extending substantially perpendicularly from the clearance plate 258 is an extension plate 259 which is directed toward the facing cabinet latch 208. The extension plate 259 provides opposed sides 260 wherein a C-channel 261 extends therebetween. The C-channel 261 includes an edge 262 extending substantially perpendicularly from the extension plate 259 and a lip 264 extending substantially perpendicular from the edge 262. The C-channel 261 provides a groove 266 between the extension plate 259, the edge 262 and the lip 264.

Each of the C-channels 220 and 261 are sized to nest with one another and provide positive latching engagement between the cabinet 204 and the door 202. Additionally, each C-channel 220, 261 extends obliquely between their respective opposed sides 217, 260. In other words, a taper is provided between the opposed sides 217, 260 such that the lip 224 is received within the groove 266 and the lip 264 is received within the groove 225. When full locking engagement is achieved, the lip 224 bears against the edge 262 and likewise, the lip 264 bears against the edge 222.

Figure 14:
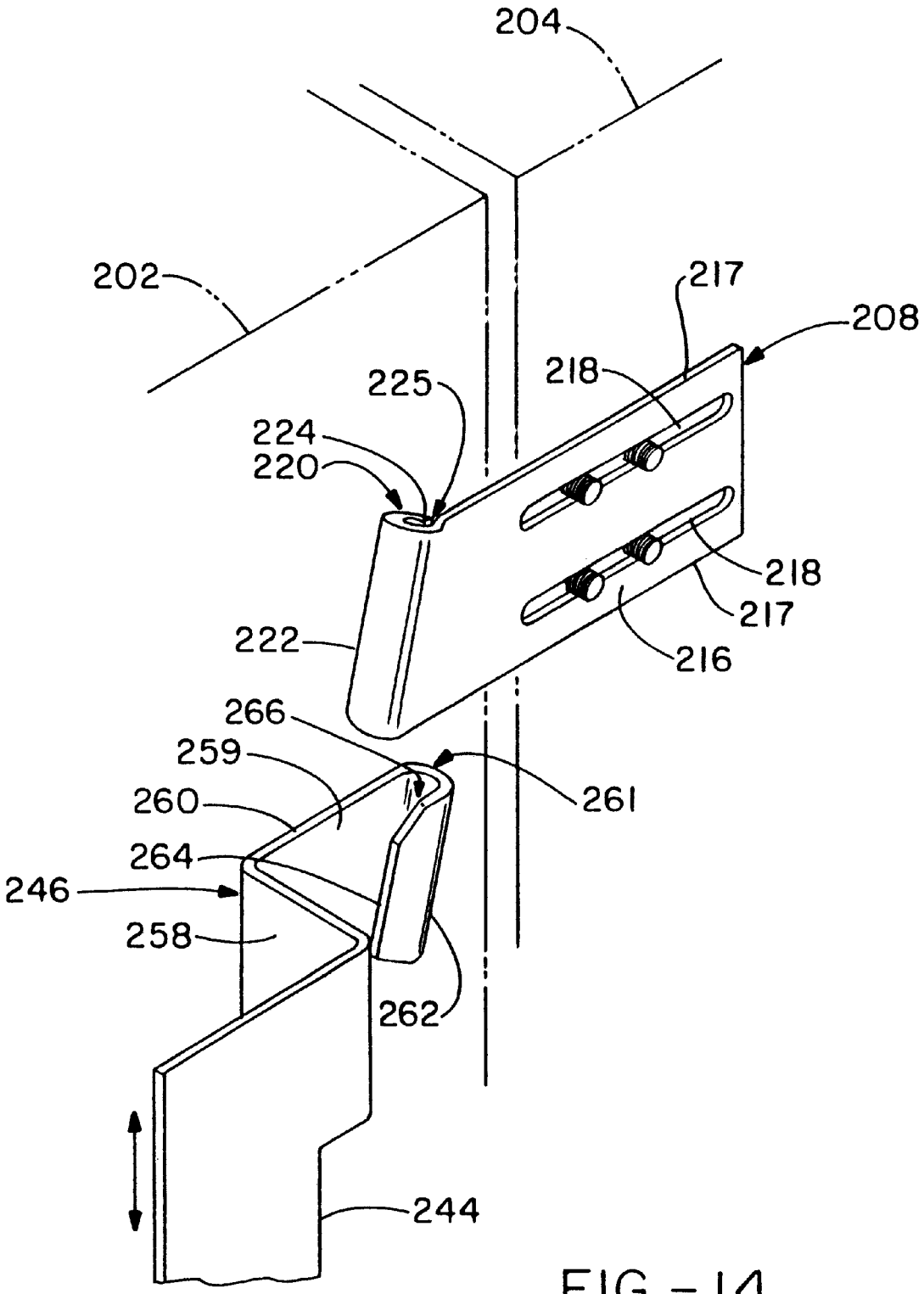
FIG. 14 is an isometric view of the locking system shown in an unengaged position.
Figure 15:
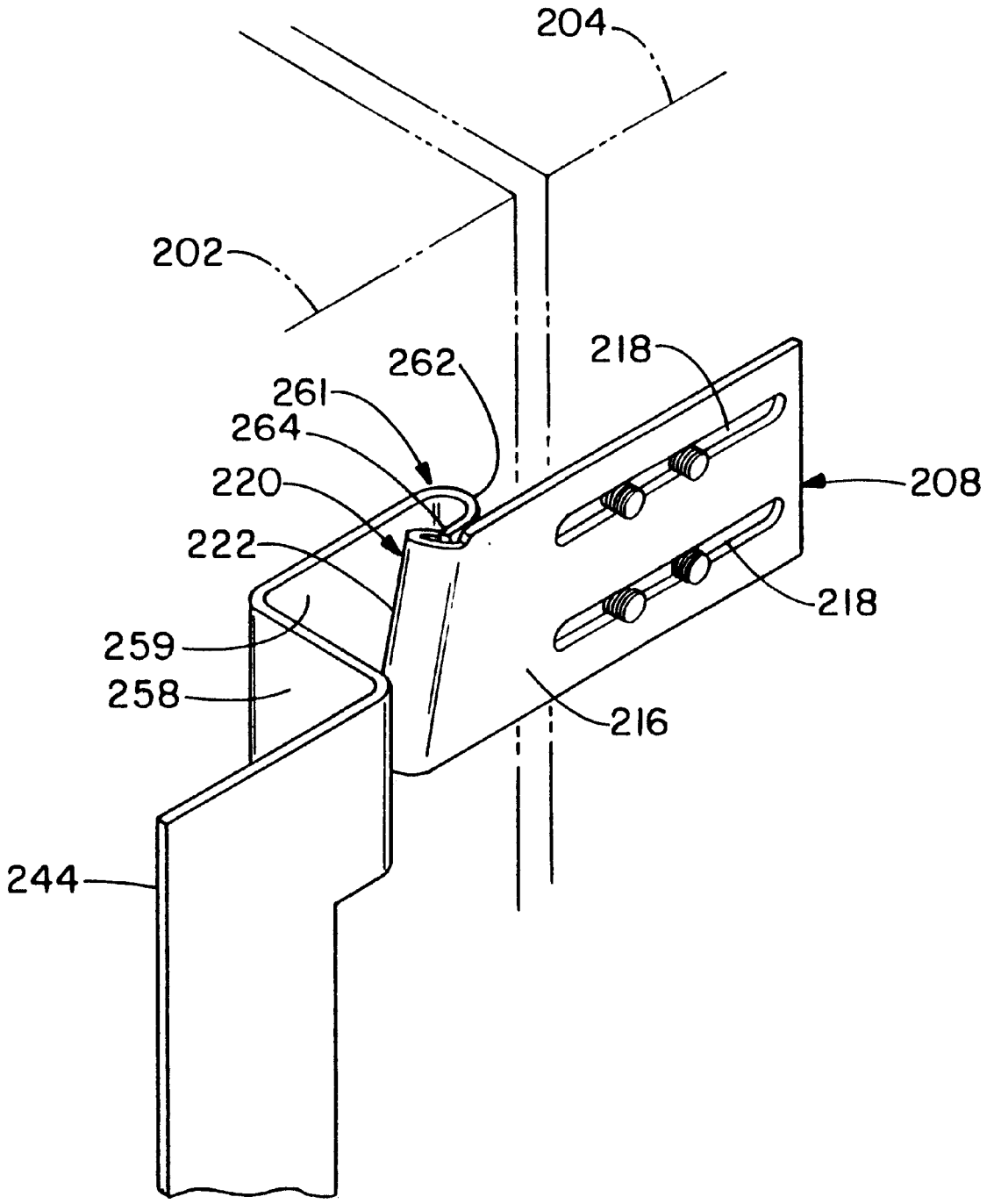
FIG. 15 is an isometric view of the present invention showing the locking system in an engaged position.

Referring now to FIGS. 14 and 15, it can be seen that upon closure of the door 202 against the cabinet 204 with the locking system in an unengaged position, the door latch 246 is disposed immediately below the mating cabinet latch 208.

As the T-bar 250 is rotated, its gear teeth 252 engage the openings 254 and cause the slide bar 244 to move upwardly. This upward motion continues until the respective C-channels 220 and 261 engage and nest with one another and can no longer move. At this time, the latches 208 and 246 are engaged as presented in FIG. 15.

Figure 16:
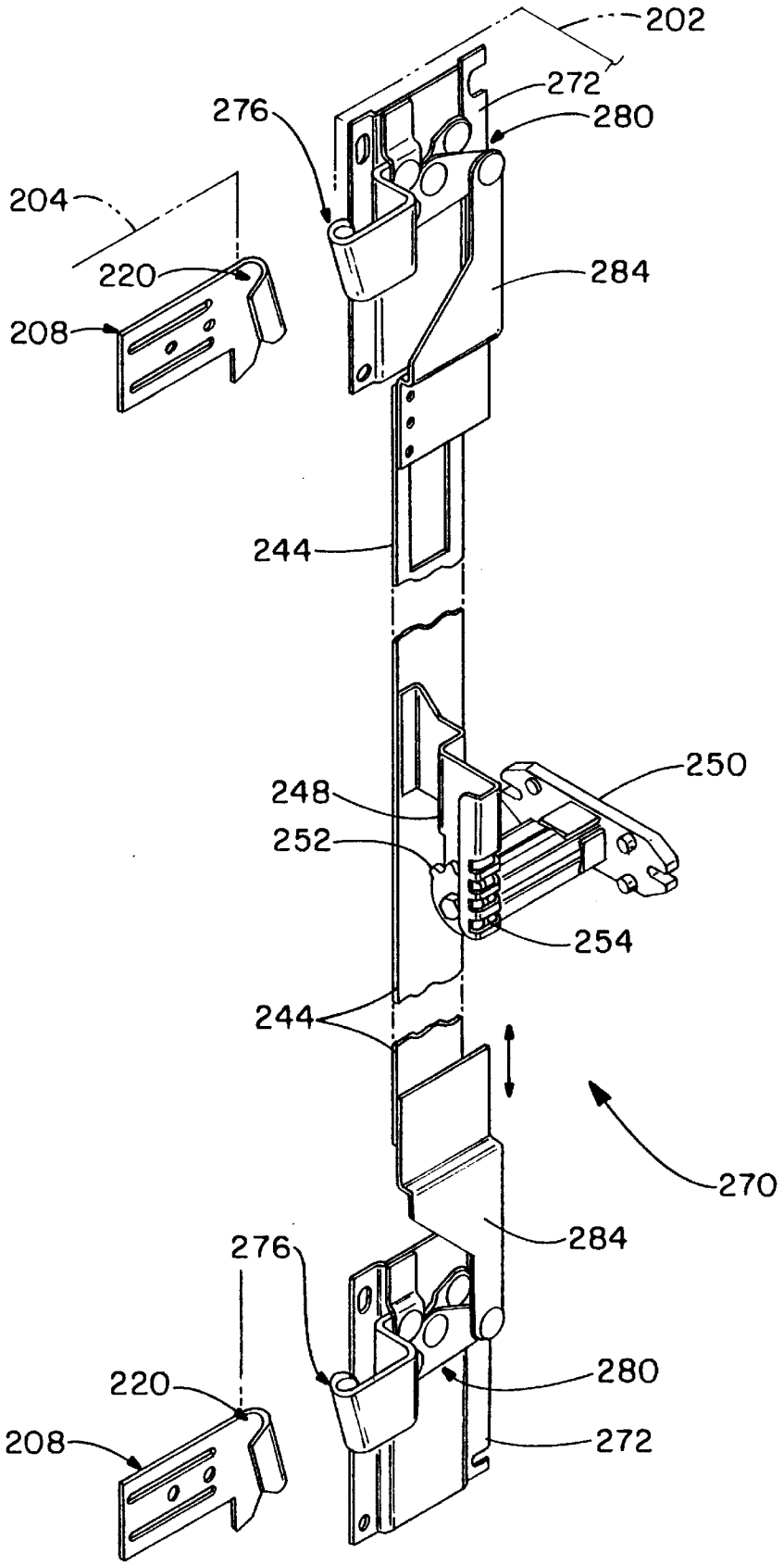
FIG. 16 is an isometric view of a locking system with an alternative latching mechanism.

Referring now to FIG. 16, it can been seen that an alternative embodiment of the locking system is designated generally by the numeral 270. The locking system 270 is similar to that of locking system 200; however, the door latches are mounted directly to the door 204, thereby improving the vandal resistance of the vending machine. In particular, a pair of mounting plates 272 are mounted to the interior edge 210 wherein door latches 276 are movably affixed thereto. A linkage mechanism 280 extends from each respective door latch 276 and is attached at an opposite end to a linkage plate 284. The opposite end of each linkage plate 284 is then secured to the slide bar 244 in a manner well known in the art.

The locking system 270 operates in much the same manner as the locking system 200, wherein rotational movement of the T-bar 250 causes linear motion of the slide bar 244. As the slide bar 244 moves in one direction, both the door latches 276 move in a corresponding direction.

Both of the locking systems 200, and 270 provide numerous advantages. First, each locking system provides at least two points of engagement between the cabinet 204 and the door 202. Most current systems only provide one point of engagement and are therefore easier to pry open by vandals. Yet another advantage of the present invention is that the cabinet latches 208 provide a very low profile to allow maximum utilization of the space within the cabinet to receive modular vending arrays as discussed previously in the application. Still another advantage of the present invention is that the tapers of the mating latches 208 with latches 246 and 276 allow positive nesting between one another. In other words, upward movement of the door by itself cannot cause disengagement of the door from the cabinet. Accordingly, a vandal would need to push down on the door to cause disengagement to the latching mechanism. However, the surface supporting the vending machine would likely preclude this motion.

Thus it can be seen that the objects of the invention have been attained by the structure presented above. While in accordance with the patent statutes only the best mode and preferred embodiments of the invention have been presented and described in detail, the invention is not limited thereto or thereby. Accordingly, for an appreciation of the true scope and breadth of the invention, referenced should be made to the following claims.

What is claimed is:

1. A dispensing detection device used in a vending machine, comprising:

a plurality of detector plates for directing a dispensed product into a receiving trough, wherein said plurality of detector plates comprises a chute plate and a cover plate substantially parallel with and covering said chute plate; and means for sensing whether a dispensed product has passed over one of said plurality of detector plates into said receiving trough, wherein said sensing means comprises a force director extending away from either said chute place or said cover plate toward the other; and a membrane switch proximate to said force director, wherein said membrane switch is disposed between said chute plate and said cover plate, wherein said force director concentrates and transfers force applied by a dispensed product to said membrane switch to facilitate detection thereof.

2. The dispensing detection device according to claim 1, wherein said force director is adjacent said cover plate and said membrane switch is adjacent said chute plate and in a normally open position, and wherein as the dispensed product passes over said force director, said force director closes said membrane switch to confirm that a product has entered said receiving trough.

3. The dispensing detection device according to claim 1, wherein said cover plate has an extending member where the vertex of said cover plate and said extending member is adjacent said force director.

4. The dispensing detection device according to claim 1, wherein said cover plate has a plurality of slots positioned over said force director to reduce pre-load forces on said membrane switch.

* * * * *